US009035739B2

(12) United States Patent
Boe et al.

(10) Patent No.: US 9,035,739 B2
(45) Date of Patent: May 19, 2015

(54) SUBSEA FUSE ASSEMBLY

(75) Inventors: Ove Boe, Tanem (NO); Sivert Eliassen, Trondheim (NO); Espen Haugan, Trondheim (NO); Oddvar Lenes, Melhus (NO); Boerge Sneisen, Hommelvik (NO); Gunnar Snilsberg, Heimdal (NO)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/002,634

(22) PCT Filed: Feb. 22, 2012

(86) PCT No.: PCT/EP2012/052966

§ 371 (c)(1),
(2), (4) Date: Nov. 11, 2013

(87) PCT Pub. No.: WO2012/116910

PCT Pub. Date: Sep. 7, 2012

(65) Prior Publication Data

US 2014/0055227 A1 Feb. 27, 2014

(30) Foreign Application Priority Data

Mar. 2, 2011 (EP) ..... 11156594

(51) Int. Cl.
*H01H 85/165* (2006.01)
*H01H 85/18* (2006.01)
(Continued)

(52) U.S. Cl.
CPC ..... *H01H 9/02* (2013.01); *H01H 85/0021* (2013.01); *H01H 85/0026* (2013.01); *H01H 85/175* (2013.01); *H01H 85/40* (2013.01); *H01H 85/0241* (2013.01)
USPC ..... 337/204; 337/186; 337/187

(58) Field of Classification Search
CPC ..... H01H 85/0021; H01H 85/0026; H01H 85/0241; H01H 85/40; H01H 9/02; H01H 85/175
USPC ..... 337/1, 187, 204
See application file for complete search history.

(56) References Cited

U.S. PATENT DOCUMENTS 1,562,984 A * 11/1925 Murray ..... 337/237
1,829,604 A * 10/1931 Natalis ..... 337/277
(Continued)

FOREIGN PATENT DOCUMENTS

CN 2693825 Y 4/2005
DE 3248080 A1 * 6/1984 ..... H01F 27/10
(Continued)

OTHER PUBLICATIONS

European Search Report and Written Opinion dated Aug. 17, 2011 for corresponding EP 11 15 6594.1.
(Continued)

*Primary Examiner* — Anatoly Vortman
(74) *Attorney, Agent, or Firm* — Lempia Summerfield Katz LLC

(57) ABSTRACT

A subsea fuse assembly is provided. The subsea fuse assembly is adapted to be operated in a pressurized environment. The subsea fuse assembly includes an enclosure adapted to be filled with a dielectric liquid, and a pressure compensator including a flexible element for pressure compensation. The subsea fuse assembly also includes a first penetrator and a second penetrator each passing through a wall of the enclosure for leading a first electric conductor and a second electric conductor, respectively, into the enclosure. The subsea fuse assembly includes a fuse arranged inside the enclosure and connected between the first electric conductor and the second electric conductor.

17 Claims, 4 Drawing Sheets

(51) Int. Cl.

| | |
|---|---|
| ***H01H 9/02*** | (2006.01) |
| ***H01H 85/00*** | (2006.01) |
| ***H01H 85/175*** | (2006.01) |
| ***H01H 85/40*** | (2006.01) |
| ***H01H 85/02*** | (2006.01) |

(56) References Cited

U.S. PATENT DOCUMENTS

| | | | | | |
|---|---|---|---|---|---|
| 2,247,084 | A | * | 6/1941 | Goff | 337/248 |
| 2,681,398 | A | * | 6/1954 | Kozacka et al. | 337/246 |
| 2,866,875 | A | * | 12/1958 | Swain et al. | 337/247 |
| 3,132,226 | A | * | 5/1964 | Bennett | 218/107 |
| 3,291,926 | A | * | 12/1966 | Nelson | 200/51 R |
| 3,522,570 | A | * | 8/1970 | Wanaselja | 337/28 |
| 3,604,873 | A | * | 9/1971 | Boliver | 218/97 |
| 3,662,309 | A | * | 5/1972 | Harmon | 337/202 |
| 3,681,731 | A | * | 8/1972 | Kozacka | 337/166 |
| 3,723,930 | A | * | 3/1973 | Koch | 337/158 |
| 3,848,215 | A | * | 11/1974 | Kozacka et al. | 337/246 |
| 3,878,314 | A | * | 4/1975 | Link | 174/37 |
| 4,012,708 | A | * | 3/1977 | Goe, Jr. | 337/205 |
| 4,028,656 | A | * | 6/1977 | Schmunk et al. | 337/186 |
| 4,083,028 | A | * | 4/1978 | Haubein et al. | 337/144 |
| 4,135,174 | A | * | 1/1979 | Biller | 337/186 |
| 4,136,339 | A | * | 1/1979 | Kuhn | 340/638 |
| 4,208,787 | A | * | 6/1980 | Luck et al. | 29/623 |
| 4,743,996 | A | * | 5/1988 | Book | 361/39 |
| D315,894 | S | * | 4/1991 | Giannini | D13/171 |
| 5,103,203 | A | * | 4/1992 | Huber | 337/248 |
| 5,270,679 | A | * | 12/1993 | Gulbrandsen | 337/252 |
| 5,977,498 | A | * | 11/1999 | Levine | 200/302.1 |
| 6,867,364 | B2 | | 3/2005 | Hafskjold et al. | |
| 7,808,362 | B2 | * | 10/2010 | Stanek et al. | 337/187 |
| 8,212,646 | B2 | * | 7/2012 | Crane et al. | 337/278 |
| 8,292,109 | B2 | * | 10/2012 | Lauk et al. | 220/89.1 |
| 8,427,807 | B2 | * | 4/2013 | Bo et al. | 361/272 |
| 2008/0212268 | A1 | * | 9/2008 | Janisch | 361/679 |
| 2009/0045906 | A1 | | 2/2009 | Stanek et al. | |
| 2009/0226262 | A1 | * | 9/2009 | Karstad et al. | 405/191 |
| 2009/0266815 | A1 | * | 10/2009 | Lauk et al. | 220/89.1 |
| 2013/0286549 | A1 | * | 10/2013 | Hazel et al. | 361/624 |

FOREIGN PATENT DOCUMENTS

| | | | |
|---|---|---|---|
| DE | 10127276 | A1 | 1/2003 |
| EP | 2 136 381 | A1 | 12/2009 |

OTHER PUBLICATIONS

International Search Report and Written Opinion of the International Searching Authority dated Jun. 22, 2012 for corresponding PCT/EP2012/052966.

PCT International Preliminary Report on Patentability dated May 28, 2013 for corresponding PCT/EP2012/052966.

* cited by examiner

SUBSEA FUSE ASSEMBLY

The present patent document is a §371 nationalization of PCT Application Serial Number PCT/EP2012/052966, filed Feb. 22, 2012, designating the United States, which is hereby incorporated by reference. This patent document also claims the benefit of EP11156594, filed on Mar. 2, 2011, which is also hereby incorporated by reference.

FIELD

The invention relates to a subsea fuse assembly adapted to be operated in a pressurized environment and to an electric device comprising such fuse assembly.

BACKGROUND

Oil platforms may be used in offshore oil and gas production. In the operation of offshore oil platforms, electronics may be installed under water (e.g., for controlling functions of a subsea Christmas tree or a subsea blowout preventer). More recently, subsea processing facilities are being established in which processing equipment such as electrically driven pumps and gas compressors are relocated to the ocean floor. The subsea processing facility may require a power grid as well as control, monitoring and communication systems. It is to be provided that the installed equipment operates reliability even under the high pressures exerted by the sea water at great depths of water of, for example, more than 1000 or even 2000 meters.

To protect equipment from overcurrents or short-circuits, fuses that interrupt an electrical connection if the current through the fuse becomes too large may be installed. A conventional fuse includes a fuse body that may be made of ceramic, glass, plastic, fiberglass or the like, and a fuse element. The fuse element may be a metal strip or wire and is connected between two electrical terminals of the fuse. At currents above the rated current, the fuse element melts, thereby interrupting the electrical circuit. The faulty circuit may thus be isolated, whereby damage to other electric components of the system may be prevented.

For providing a fuse for subsea applications, a conventional fuse may be placed into a pressure resistant canister that is maintained at a pressure of about one atmosphere. The canister is to be thick walled in order to withstand the high pressures at water depths of more than 2000 m. Sophisticated penetrators capable of bridging such high pressure differences are further used to provide an electrical connection to the fuse through the walls of the canister. This solution of providing a fuse for a subsea application is very cost intensive due to the canister and the penetrators and further uses a considerable amount of space. The canister is also very heavy.

Solutions in which electric components are placed in pressure compensated canisters have also been provided. The canisters are filled with a dielectric liquid, and a pressure is maintained inside the canister that is almost equal to the surrounding water pressure. Standard fuses may be incompatible with such an environment. The dielectric liquid changes the properties of a conventional fuse dramatically. The fuse will still be capable of breaking a current when triggered, but this will cause an explosion inside the fuse, which may be detrimental to other electric components (e.g., due to a shockwave or shrapnel). The combustion products of the explosion may contaminate the surrounding dielectric liquid severely. This may cause failures in other components exposed to the dielectric liquid. Conventional fuses may thus not be used in a pressurized environment.

SUMMARY AND DESCRIPTION

A fuse for subsea applications that is compact and comparatively light weight is to be provided. The fuse is to be capable of being operated in a pressurized environment (e.g., a dielectric liquid environment). It would be beneficial if the fuse may be manufactured at comparatively low cost.

The scope of the present invention is defined solely by the appended claims and is not affected to any degree by the statements within this summary.

The present embodiments may obviate one or more of the drawbacks or limitations in the related art. For example, an improved fuse for subsea applications that mitigates at least some of the drawbacks mentioned above is provided.

According to an embodiment, a subsea fuse assembly adapted to be operated in a pressurized environment is provided. The subsea fuse assembly includes an enclosure adapted to be filled with a dielectric liquid and a pressure compensator including a flexible element for performing a pressure compensation (e.g., a pressure equalization between the inside of the enclosure and the outside of the enclosure). The pressure compensator is mounted to the enclosure. The pressure compensator (e.g., the flexible element of the pressure compensator) is adapted to seal an opening in the enclosure. The subsea fuse assembly further includes a first penetrator and a second penetrator each passing through a wall of the enclosure for leading a first electric conductor and a second electric conductor, respectively, into the enclosure. The subsea fuse assembly includes a fuse arranged inside the enclosure and connected between the first and the second electric conductors. The assembly is configured such that the inside of the enclosure is sealed to the outside of the enclosure.

As the fuse is confined in the enclosure and sealed to the outside, damage to components outside the enclosure may be prevented when the fuse is triggered (e.g., the fuse breaks/blows). For example, the enclosure may provide a substantially liquid tight or even fluid tight seal against the outside of the enclosure. If the fuse explodes in the dielectric liquid filled enclosure, a contamination of a dielectric liquid outside the enclosure with combustion products from the explosion may be prevented. As the enclosure includes a pressure compensator (e.g., the enclosure is a pressure compensated enclosure), the enclosure may be deployed in a pressurized environment without requiring thick walls to withstand large pressure differences. The enclosure may thus be compact and relatively light weight. Using, for example, the flexible element of the pressure compensator sealing the opening in the enclosure against the outside of the enclosure, a pressure balancing between the outside of the enclosure and the inside of the enclosure may be achieved. The penetrators only need to withstand a small pressure difference, which further reduces complexity and technical efforts. The fuse assembly may thus be manufactured cost efficiently.

In an embodiment, the pressure compensator is adapted to be capable of equalizing a pressure inside the enclosure to a pressure outside the enclosure when the subsea fuse assembly is deployed in a pressurized environment. The pressure compensator thus performs a pressure compensation between the inside of the enclosure and the outside of the enclosure. In an embodiment, the flexible element of the pressure compensator seals the opening of the enclosure against the outside of the enclosure. The flexible element may be deformable such that a deformation of the flexible element results in a change of the volume confined by the enclosure. Since a change of the dielectric liquid filled volume results in a corresponding pressure change, the pressure may be equalized by a deformation of the flexible element (e.g., the pressure inside the enclosure is balanced to the pressure outside the enclosure).

In an embodiment, the flexible element may include a membrane. The membrane may be arranged to seal the opening in the enclosure. The membrane may be deformable into an equilibrium position in accordance with a force applied to the membrane by a pressure outside the enclosure and a force applied to the membrane by a pressure inside the enclosure. In the equilibrium position, the membrane will deform such that both forces are about equal (e.g., neglecting any additional forces applied by a tension in the membrane or the like). In other words, the membrane would deform to increase the confined volume if the pressure inside the enclosure is larger (and thus the force acting on the membrane), and the membrane would decrease the confined volume if the pressure inside the enclosure is smaller than the outside pressure, thereby decreasing or increasing the pressure inside the enclosure, respectively. Consequently, the pressure is equalised or balanced between the inside of the enclosure and the outside of the enclosure in the equilibrium position of the membrane. The pressure inside the enclosure may, for example, be equalized to the pressure existing in a subsea device in which the subsea fuse assembly is installed. The subsea device may be filled with dielectric liquid and may include a pressure compensator, so that when the subsea device is installed at the sea bed, the pressure inside the subsea device and thus the pressure acting on the subsea fuse assembly may be substantially similar to the water pressure at the location of the subsea device.

In other words, the flexible element may be deformable such that the volume confined by the enclosure may be varied (e.g., compression/expansion of a bellow or bladder, deformation of the surface of a membrane). Thereby, a pressure balancing between the inside of the enclosure and the outside of the enclosure is provided. The flexible element may, for example, be configured such that a difference in the pressure inside the enclosure and the pressure outside the enclosure results in a movement of the flexible element to an equilibrium position in which, due to the volume change, the inside pressure is balanced to the outside pressure.

As an example, deformation of the flexible element in one direction may increase the volume confined in the enclosure, whereas deformation in another direction may decrease the volume (e.g., a membrane or a bellow sealing the opening and deforming in one or the other direction). Since the enclosure is sealed and filled with a dielectric liquid, small movements of the flexible element may lead to considerable pressure changes inside the enclosure. If the subsea fuse assembly is deployed in a pressurized environment, different pressures inside and outside the enclosure would result in different forces acting on the flexible element. This would accordingly deform into a position in which the forces are balanced. In the equilibrium position, the pressures inside the enclosure are thus equalized or balanced to the pressure outside the enclosure.

In equalization/pressure compensation, the inside and outside pressures are only equal to within certain margin. A small negative pressure or overpressure may be maintained inside the enclosure (e.g., to prevent the leaking or entering of dielectric liquid, respectively). This may be achieved by biasing the pressure compensator correspondingly (e.g., by applying an additional force on the flexible element). This may be done by a weight, a spring, an intrinsic spring constant of a bellow, membrane tension or other methods. The pressure difference in the equalized state may, for example, be smaller than 1 bar (e.g., smaller than 500 mbar). This pressure difference is less than 0.5% of the absolute pressure at a deployment depth of 3000 m (300 bar).

In a further embodiment, the flexible element is a membrane, a bladder, a bellow, or a combination thereof. Such flexible elements are capable of providing good pressure compensation. The flexible elements are strong and flexible enough to withstand a shockwave that is produced when the fuse is triggered.

The flexible element may, for example, be a membrane (e.g., a rubber membrane, a nitrile rubber membrane, a thermoplastic polyurethanes (TPU) membrane, a membrane comprising polyester filaments, a membrane comprising polyvinyl chloride (PVC), or a butyl rubber membrane). The membrane may also include a combination of the above features. For example, the membrane may be a TPU membrane including polyester filaments.

The enclosure may be made of metal (e.g., the enclosure may be a metal enclosure). The first and second penetrators may be insulating penetrators that include insulating material arranged around the first electric conductor and the second electric conductor, respectively, so as to provide electrical isolation to the metal enclosure.

The fuse arranged inside the enclosure and connected between the first and the second electric conductors may include a fuse housing. The fuse element may be enclosed in the fuse housing, thus providing protection for the fuse element and a first barrier against elements produced when the fuse blows. The fuse housing may be a ceramic housing. Ceramics may be a hard and temperature resistant material, thus providing a good encapsulation of the fuse element. The fuse housing may also be filled with sand. This may provide a further protection when the fuse is triggered and may reduce the arcing time. The fuse housing may not be sealed so that dielectric liquid may enter and fill the housing. This way, the fuse does not collapse when the enclosure is pressurized. In other configurations, the fuse housing may be sealed with a rubber (e.g., a flexible rubber top that may enable a pressure compensation, or may be provided with a filter/membrane).

The fuse arranged inside the enclosure and connected between the first and the second electric conductors may include, for example, two terminals and a fuse element coupled between the two terminals. Using the terminals, which may be simple conductor sections (e.g., short metal strips), the fuse may be coupled to the conductors reaching into the enclosure. For example, each terminal may be directly attached to a section of the electric conductor that extends from the penetrator into the enclosure. The enclosure may thus be kept compact. In some embodiments, the fuse may only include the connectors and the fuse element (e.g., the fuse may not include a fuse housing).

The fuse element may include a metal wire or a metal sheet (e.g., a perforated metal sheet).

In an embodiment, the subsea fuse assembly further includes at least a second fuse and two further penetrators each passing through a wall of the enclosure. The second fuse is connected between conductors lead into the enclosure by the two further penetrators. A compact design may thus be achieved in cases where more than one fuse is used. The fuse assembly may include even more fuses (e.g., 3, 4, 5 or more fuses), with each being contacted via a pair of respective penetrators. In other embodiments, one side of the fuses may be contacted via a conductor lead into the enclosure via only a single penetrator (e.g., in cases where all fuses are connected to a common energy source). The distances between the fuses may be selected so as to be large enough to prevent leakage currents or arcing. For example, the creeping distances (e.g., shortest distance between two points along the surface of an insulation material) may be made large enough to prevent the above effects.

The penetrators may be adapted to provide an electric insulation between the enclosure and the respective electric conductor, and to provide a seal between the inside of the enclosure and the outside of the enclosure. By providing a seal around the conductors, the leaking of dielectric liquid and thus combustion products to the outside of the enclosure may be prevented. The penetrator may be a through connector. Each penetrator may further mechanically support the respective electric conductor against the enclosure.

Each penetrator may have an elongated shape. The penetrator may be made of insulating material that surrounds the respective electric conductor. The insulating portion of the penetrator may extend into the enclosure far enough so as to achieve a creeping distance between an exposed portion of the conductor and a wall of the enclosure that is high enough to prevent a short circuit or leakage currents via the enclosure.

The fuse may be a low voltage fuse or a medium voltage fuse. The fuse may thus be adapted for operating in a voltage range of 100V to 1.000V or of 1.000V to 50.000V, respectively. The fuse assembly may, for example, be deployed for protecting a transformer from a failure in other electric components connected thereto. The fuse may have a current rating in a range of 500 to 10.000 A (e.g., in the range of 1.000 to 5.000 A). In one embodiment, the current rating will be adapted to the particular application in which the fuse assembly is used. The current rating defines a threshold current, above which the fuse breaks (e.g., maximum momentary current rating). The nominal operating current (e.g., continuous current rating) may be lower. The nominal operating current may lie within a range of 100 A to 1.000 A. These ratings may be for an operation at 690 V AC (alternating current).

The sealing between the inside of the enclosure and the outside of the enclosure may be a fluid-tight sealing. For example, the sealing may be adapted to confine the dielectric liquid and gases which may be produced when the fuse is triggered inside the enclosure. The sealing may be provided at the openings of the enclosure. The sealing may include a sealing by the penetrators and by the pressure compensator.

The enclosure may include more than one opening that is sealed by the pressure compensator. The enclosure may include 2, 3, 4 or a plurality of openings sealed each by a pressure compensator or sealed by a common pressure compensator. A membrane may, for example, cover more than one opening for providing a sealing and pressure compensation. An opening may be a hole in the enclosure, or the opening may be a larger opening, such as a missing wall of a box-shaped enclosure.

In an embodiment, the enclosure is a box shaped enclosure having an open side that corresponds to the opening, the flexible element being a membrane sealing the open side. The membrane may thus be made sufficiently large and thus flexible to withstand a shockwave produced by the fuse when the fuse is triggered (e.g., when an explosion occurs in the fuse). The triggering of the fuse may produce gases, resulting in a rapid volume expansion and thus in a shockwave.

The flexible element may, for example, be a membrane that substitutes a wall for the enclosure (e.g., the membrane may constitute a wall of the enclosure separating the outside of the enclosure from the inside of the enclosure).

At the open side of the enclosure, the enclosure may be provided with a flange. The membrane may be arranged and compressed between this flange and a further mating flange. The mating flange may have a rectangular shape, corresponding to the shape of the flange of the enclosure. Compression may be achieved fastening members (e.g., bolts or screws) arranged around and passing through both flanges. The membrane forming a barrier between the inside and the outside of the enclosure may thus be sealed against the opening and held in place.

The size of the enclosure may be adapted in accordance with the number of fuses it houses. The size may, for example, be larger than 10×10×5 cm.

The enclosure may be made from metal. The enclosure may further be provided with a layer of insulating material lining the inner faces of the enclosure. The insulating material may, for example, be a polycarbonate material.

In an embodiment, the enclosure is filled with dielectric liquid. The fuse is submerged in the dielectric liquid. The dielectric liquid may thus enter the fuse, thereby preventing any damage to the fuse when the enclosure is pressurized (e.g., when the enclosure is deployed for operation).

The fuse assembly may be configured such that the only electric elements disposed in the enclosure are the one or more fuses and the electric conductors coupled to the respective fuse(s). A compact design may thus be achieved.

A further aspect relates to a subsea electric device including a pressure compensated enclosure filled with dielectric liquid, an electric component submerged in the dielectric liquid, and a subsea fuse assembly having any of the configurations mentioned above, or combinations thereof. The subsea fuse assembly is submerged in the dielectric liquid and is electrically coupled to the electric component.

The fuse assembly may provide a short circuit protection or overcurrent protection for the electric component (e.g., for a transformer or the like). A fuse of the fuse assembly may, for example, be connected in series between the electric component and a further upstream or downstream electric component, so that one component is protected in case of a failure in the other. As the fuse assembly is sealed, the dielectric liquid in the enclosure of the electric device is not polluted with combustion products if the fuse blows. Also, as the fuse assembly does not require a pressure resistant canister maintained at one atmosphere, the fuse assembly is compact and lightweight, so that the electronic device may also be configured compact and lightweight. The fuse assembly also enables the use of fuses having a comparatively simple design.

The features of the aspects and embodiments described above and the embodiments yet to be explained below may be combined with each other unless noted to the contrary.

BRIEF DESCRIPTION OF THE DRAWINGS

In the drawings, like reference numerals refer to like elements.

DETAILED DESCRIPTION

Figure 1:
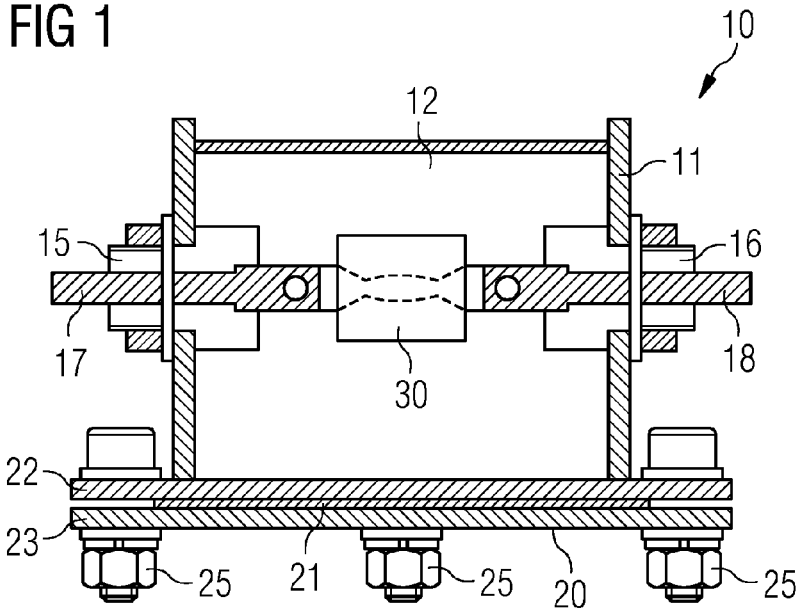
FIG. 1 is a schematic drawing showing a sectional side view of one embodiment of a subsea fuse assembly.

In the following, embodiments will be described in detail with reference to the accompanying drawings. The following description of the embodiments is given only for the purpose of illustration and is not to be taken in a limiting sense.

The drawings are to be regarded as being schematic representations only, and elements in the drawings are not necessarily to scale with each other. Rather, the representation of the various elements is chosen such that their function in general purpose becomes apparent to a person skilled in the art.

Figure 2:
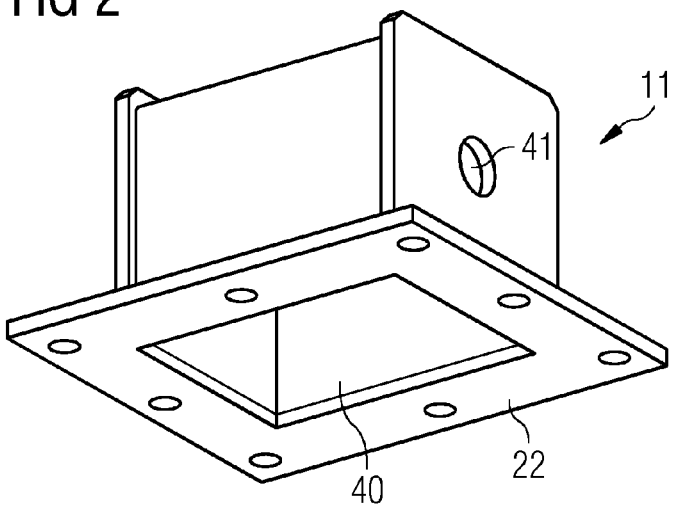
FIG. 2 is a schematic drawing showing a perspective view of one embodiment an enclosure of the subsea fuse assembly of FIG. 1.

FIG. 1 shows one embodiment of a subsea fuse assembly 10 including an enclosure 11. As illustrated in FIG. 2, the enclosure 11 has two openings 41 (one of which is not visible due to the perspective), through which electric conductors 17, 18 pass into the enclosure 11. The subsea fuse assembly 10 also includes a larger opening 40, towards which a pressure compensator 20 is mounted. Openings 41 are sealed by penetrators 15 and 16 (e.g., two penetrators). The opening 40 is sealed by a membrane 21 of the pressure compensator 20. A fluid tight seal may be provided between the inside and the outside of the enclosure 11.

Using the two penetrators 15 and 16, the electric conductors 17 and 18 are lead into the enclosure 11. The penetrator may be made of plastic material or a resin that encloses the respective electric conductor and provides a fluid tight seal around the conductor. The penetrator is mounted in the opening 41 of the enclosure such that a fluid tight seal is provided. As illustrated in FIG. 1, a protruding rim of the penetrator may be pressed against the wall of the enclosure surrounding the opening in order to provide the seal. Other possibilities of mounting the penetrators may be provided. The penetrators may also be termed through connectors.

A fuse 30 is electrically connected between the electric conductors 17 and 18. For example, the fuse 30 is attached to ends of the conductors that extend from the penetrators 15 and 16 into the enclosure 11. The fuse 30 is mechanically supported by the electric conductors 17 and 18.

The fuse 30 may be mounted to the ends of the electric conductors 17 and 18 in any number of ways. The terminals of the fuse 30 may be attached by mechanical fastening elements, such as bolts and nuts, to the ends of the conductors 17, 18. Attachment may also occur or may be supported by soldering or welding. The fuse terminals may, for example, be hollow flat cylinders that are slipped over the conductor ends and attached thereto. In other embodiments, the fuse terminals and the electric conductors may be integrally formed (e.g., the fuse terminals may extend through the openings in the enclosure 11 to the outside of the enclosure 11).

Outside the enclosure 11, the electric conductors 17, 18 may be contacted for integrating the fuse 30 into an electric circuit. The fuse 30 may, for example, be connected between a first electric component (e.g., a transformer that is to be protected) and a second electric component (e.g., a variable speed drive (VSD) in which a failure may cause an overcurrent or a short circuit). The fuse 30 is adapted to be triggered (e.g., to blow or break) if a current larger than a threshold current passes through the fuse 30. Depending on the type of fuse, the triggering may, for example, occur by the melting of a fuse element. This is explained in more detail further below with respect to FIG. 4. The electric connection between electric conductors 17 and 18, which the fuse 30 provides, is interrupted when the fuse 30 blows, thereby preventing further damage to upstream or downstream electric components.

The enclosure 11 is a pressure compensated enclosure, as the enclosure 11 includes the pressure compensator 20. In the present embodiment, the pressure compensator 20 includes a flexible element in the form of a membrane 21 that covers the opening 40 of the enclosure 11 and is compressed between two flanges 22 and 23. Flange 22 is part of the enclosure 11, as illustrated in FIG. 2. Mating flange 23 has essentially the same shape as flange 22. For example, the mating flange 23 has through holes at the same positions as flange 22. Using bolts and nuts 25, the two flanges 22, 23 are compressed against each other, thereby compressing the membrane 21 disposed between the flanges and covering the opening 40. By compressing the membrane 21 around the opening 40, a fluid tight seal is provided for the opening 40.

The subsea fuse assembly 10 is adapted to be operated in a pressurized environment (e.g., in an environment having a pressure higher than one atmosphere; in a pressure compensated enclosure or canister of a subsea electric device). When the electric device is deployed subsea, the pressure in the surroundings of the enclosure increases dramatically with deployment depth. Due to the pressure compensation, the pressure inside the electric device also increases correspondingly, so that the fuse assembly 10 is exposed to such high pressures. To enable the use of a thin walled enclosure 11 while at the same time preventing the enclosure 11 from collapsing, the enclosure 11 is filled with a dielectric liquid 12 before deployment. The dielectric liquid 12 experiences only small volume changes when the pressure increases and furthermore provides electric insulation. When the pressure in the surroundings of the fuse assembly 10 increases, the membrane 21 transmits the pressure to the inside of the enclosure 11. The small amount of volume change experienced by the dielectric liquid 12 may be compensated by a corresponding deformation of the membrane 21. Thus, a close to zero differential pressure may be maintained between the inside and the outside of the enclosure even at large outside pressures. The fuse assembly 10 may, for example, be adapted for an operation at a water depth of more than 1000 m, 2000 m, or even 3000 m. The fuse assembly 10 may thus be adapted to be operated in an environment having a pressure of more than 100, 200 or even 300 bar.

Due to the pressure equalization provided by the membrane 21 of the pressure compensator 20, the walls of the enclosure 11 may be made relatively thin, as the walls do not need to withstand high differential pressures. The absence of high differential pressure further facilitates the sealing of openings 40, 41 of the enclosure 11 by the membrane 21 and the penetrators 15, 16. In consequence, the subsea fuse assembly 10 is relatively compact and lightweight, and the subsea fuse assembly 10 may be manufactured cost efficiently.

The fuse 30 is submerged in the dielectric liquid 12 that will enter the fuse housing. When the fuse 30 blows, the arcing will produce gases and thus a rapid volume expansion, leading to a small explosion, a shockwave and the creation of combustion products. The explosion may destroy the housing of the fuse 30, resulting in shrapnel being projected.

The membrane 21 is adapted to withstand the shockwave of the explosion. The membrane 30 may be flexible so that the membrane 21 may bulge outwardly and thus withstand the shockwave and the volume increase due to the produced gases. The membrane 21 may also be adapted to withstand the projected shrapnel from the fuse housing. The elasticity of the membrane 21 may prevent the membrane 21 from being pierced by shrapnel. The membrane 21 may be a membrane that is reinforced by a fiber mesh or the like.

The membrane 21 may be made of extruded thermoplastic polyether based polyurethane (TPU). Other possibilities include a rubber membrane, a nitrile rubber membrane, a butyl rubber membrane, a polyvinyl chloride (PVC) membrane, and the like. The membrane 21 may be reinforced with fibres (e.g., with a woven filament polyester yarn). The membrane 21 is chosen in accordance with the required flexibility and resistance against puncturing.

As the enclosure 11 is sealed to the outside, no combustion products produced when the fuse 30 is triggered may leave the enclosure 11. Combustion products such as, for example, gases, carbon compounds and the like are confined to the fuse assembly 10 and may not pollute the dielectric liquid in which the fuse assembly 10 is disposed when deployed subsea. Damage to other electric components outside the enclosure 11 may thus be prevented.

FIG. 1 illustrates only one possibility of implementing a pressure compensator. Other implementations that may be provided include a bellow or a bladder attached to an opening in the enclosure 11 or the like. The pressure compensator may further be biased (e.g., by pretensioning the flexible element in a certain direction), whereby an inside pressure in the enclosure may be generated that is higher or lower than the outside pressure. Such pressure differences are comparatively small compared to the absolute pressures in the deployed state. The system is thus still considered to be pressure compensated or equalized even if such small pressure differences exist.

As there is no housing around fuse 30 that is to be kept at a pressure close to one atmosphere, the fuse assembly 10 is compact. The size is chosen in accordance with the size and number of fuses that are provided in the enclosure 11. The sizing of the enclosure 11 may consider creeping distances. The enclosure 11 may be made from a metal and may thus be a conductor. To prevent leakage currents or arcing, sections of the penetrators 15 and 16 that protrude into the enclosure 11 may be made large enough so as to provide a sufficient creeping distance between the electric conductors 17, 18 and the enclosure 11. The size of the enclosure 11 may, for example, be larger than 10×10×5 cm. The inside of the enclosure 11 may further be lined with an insulating material in order to prevent leakage currents or arcing.

Figure 3:
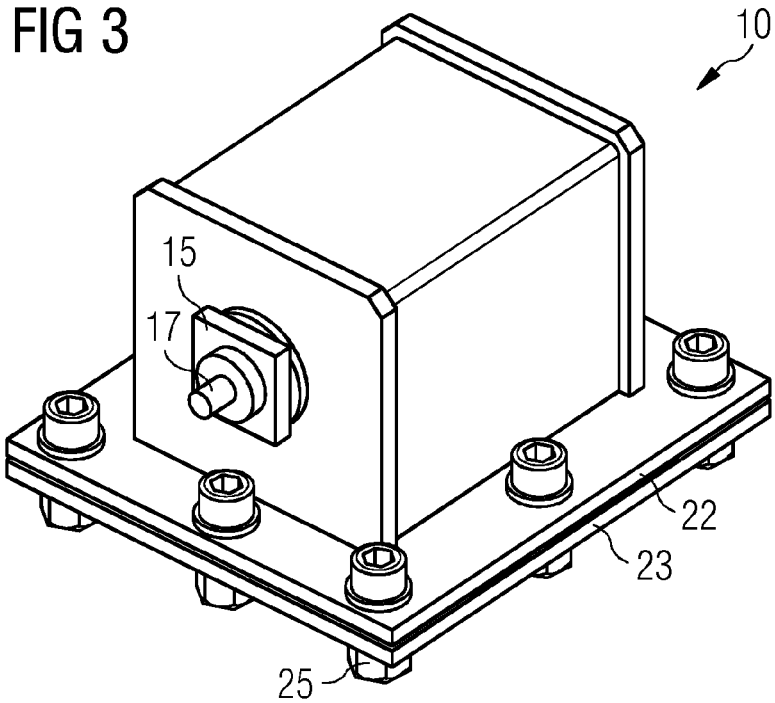
FIG. 3 is a schematic drawing showing a perspective view of one embodiment of the subsea fuse assembly of FIG. 1.

FIG. 3 shows a perspective view of one embodiment of the subsea fuse assembly 10. Parts of the penetrator 15 and of the conductor 17 that are located outside the enclosure 11 are visible. Penetrator 15 seals the opening 41.

Figure 4:
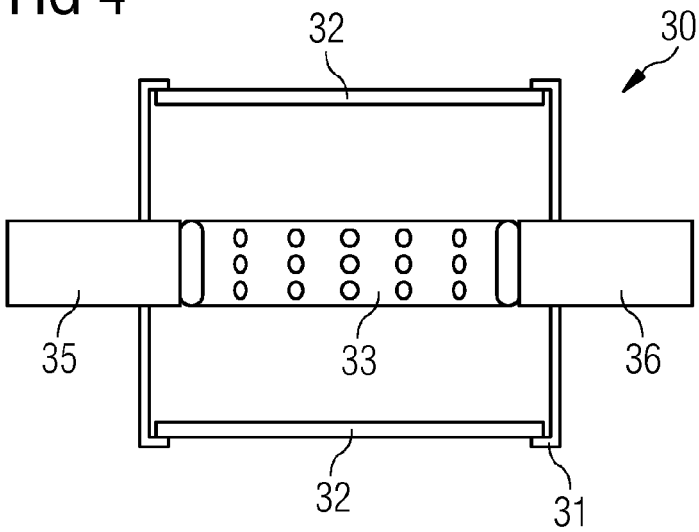
FIG. 4 is a schematic drawing showing a sectional side view of one embodiment of a fuse that may be used in embodiments of the subsea fuse assembly.

FIG. 4 shows one embodiment of a fuse 30 that may be used in any of the embodiments described herein. The fuse 30 includes two terminals 35 and 36. The terminals 35, 36 are electrically coupled to each other by fuse element 33. In the example of FIG. 4, the fuse element 33 is a perforated metal sheet. The fuse 30 may include other types of fuse elements, such as one or more wires, two or more perforated metal sheets, plain metal sheets and the like. The design of the fuse element determines the current rating of the fuse (e.g., above which current the fuse will break the electric connection between the two terminals). Above the threshold current, the current through the fuse element 33 heats the fuse element 33 to above a melting point, so that the fuse element 33 will finally melt.

The fuse 30 includes a fuse housing 31. The fuse housing 31 includes, for example, a ceramic cylinder 32 that has a high hardness and is heat resistant. The fuse housing 32 may also be filled with sand.

When the fuse 30 is submerged in the dielectric liquid, the liquid will enter the fuse housing 31. This has the effect that the fuse 30 may be pressurized without causing damage to the fuse 30. The heating and the melting of the fuse element 33 in the dielectric liquid may create gases and combustion products. The sudden volume expansion may even lead to the rupturing of the fuse housing 33. Yet as the fuse 30 is encapsulated in the enclosure 11, the gases and combustion products as well as fragments of the housing are confined and may not pollute the dielectric liquid in which the fuse assembly 10 is disposed.

The explanations given above with respect to FIGS. 1-4 similarly apply to the embodiments explained further below with respect to FIGS. 5-8, unless noted to the contrary.

Figure 5:
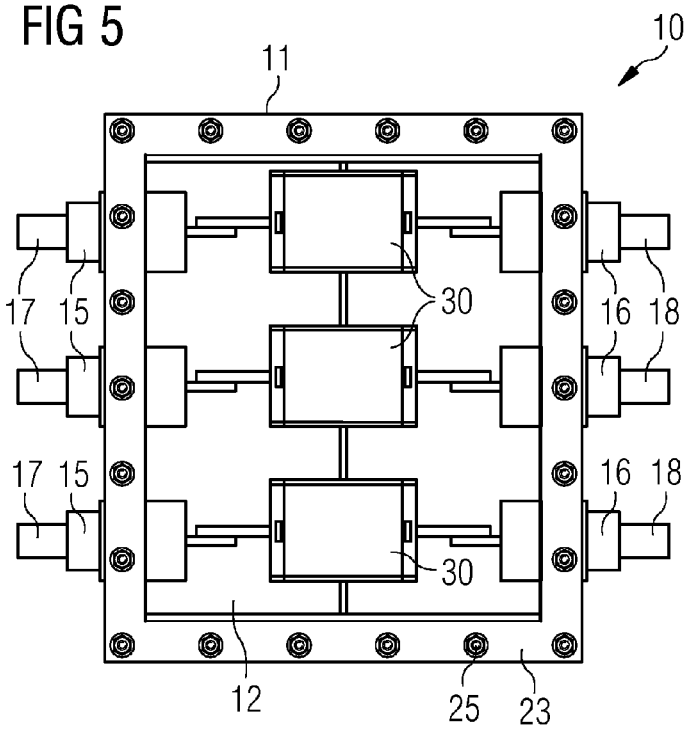
FIG. 5 is a schematic drawing showing a top view of an embodiment of a subsea fuse assembly including three fuses.

FIG. 5 illustrates one embodiment of a subsea fuse assembly 10 including three fuses 30 that may be of the type mentioned above. The design of the fuse assembly is similar to the one shown in FIGS. 1-3. The fuse assembly 10 includes an enclosure 11 filled with dielectric liquid 12. For each fuse 30, two penetrators 15, 16 with conductors 17, 18, in between which the fuse 30 is connected, are provided. The flange 23 is pressed against the enclosure 11 by bolts 25. The membrane compressed between the flange 23 and the enclosure 11 is shown transparent (i.e., not shown) in order to provide a view of the inside of enclosure 11. Each fuse 30 may be contacted by the respective electric conductors 17, 18.

The spacing of the fuses 30 is such that creeping distances are kept large enough to prevent any leakage currents or sparking. The subsea fuse assembly 10 may include any number of fuses (e.g., 2, 4, or 5 fuses). In one embodiment, between 1 and 10 fuses are provided in the enclosure 11.

Other configurations of the electric circuitry different than the one illustrated in the figures may be used. As an example, one terminal of a number of fuses 30 may be connected to a common conductor. Only one penetrator is used for providing an electrical connection to the conductor through the enclosure 11. This may be beneficial in cases where the fuses are connected between the same power source and different electric components.

Figure 6:
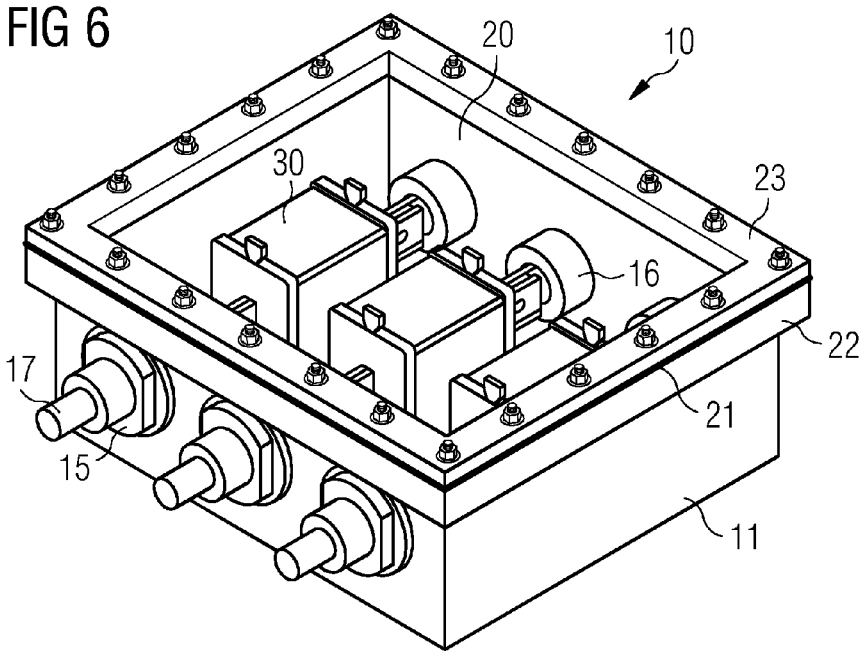
FIG. 6 is a schematic drawing showing a perspective view of one embodiment of the subsea fuse assembly of FIG. 5.

FIG. 6 shows a perspective view of one embodiment of the subsea fuse assembly 10 of FIG. 5. Again, the membrane 21 is shown transparent in order to enable a view of the components inside the enclosure 11. The inner walls of the enclosure 11 are fitted with an insulating material in order to prevent short circuiting through the enclosure 11.

Figure 7:
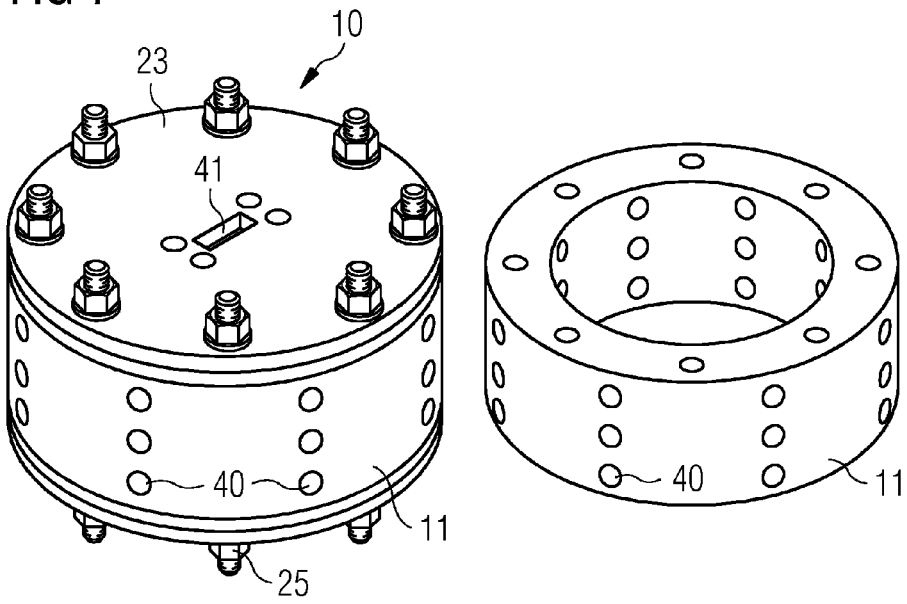
FIG. 7 is a schematic drawing showing a perspective view of an embodiment of a subsea fuse assembly including a cylindrical enclosure.

FIG. 7 illustrates an embodiment in which the enclosure 11 has a cylindrical shape. The holes 40 are covered by a membrane that provides sealing and pressure compensation. Open ends of the cylinder are sealed off by blind flanges 23 that include an opening 41 for the penetrator and conductor for contacting the fuse 30. The right part of FIG. 7 shows the enclosure 11 in the disassembled state. The flanges 23 are again mounted to the enclosure 11 by bolts and nuts 25.

From the explanations given above, the skilled person will appreciate that a plurality of possibilities exit for designing the pressure compensated enclosure of the fuse assembly, and that the designs given herein are only few specific examples.

Figure 8:
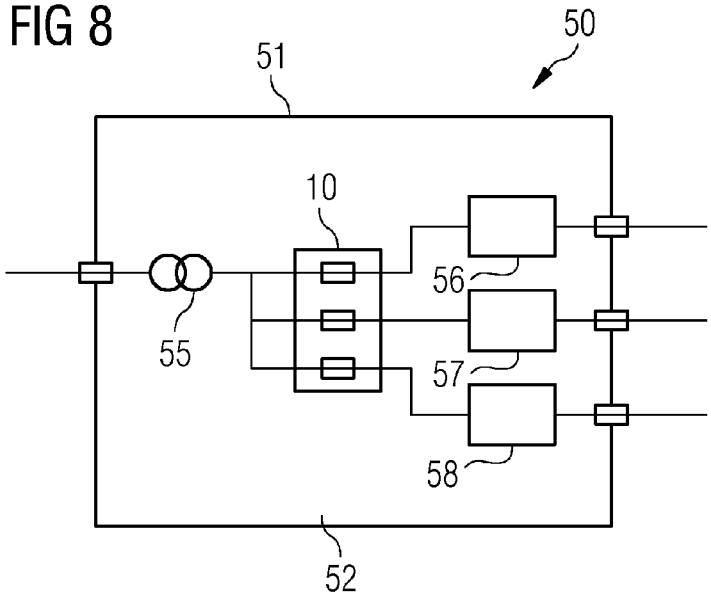
FIG. 8 is a schematic block diagram showing one embodiment of a subsea electric device.

FIG. 8 is a schematic block diagram of one embodiment of an electric device 50. The electric device 50 includes a pressure compensated enclosure 51 in which electric components 55-58 are disposed and that is filled with a dielectric liquid 52. The fuse assembly 10 is connected to the electric components and provides short circuit or overcurrent protection. In the example of FIG. 8, one embodiment of a subsea fuse assembly 10 similar to the one illustrated in FIGS. 5 and 6 that includes three fuses is used. Any of the subsea fuse assemblies disclosed herein may be used in the electric device 50.

In the example of FIG. 8, one terminal of each of the fuses of the subsea fuse assembly 10 is electrically connected to the transformer 55, which delivers power for operating the electric components 56-58. The other terminal of each fuse is connected to one of the components 56-58. If a short circuit occurs in one of the electric components (e.g., component 56), the respective fuse in the subsea fuse assembly 10 will blow. The electric component 56 in which the fault occurred is thus electrically separated from the power supply. This prevents damage to the transformer 55 and the remaining electric components 57, 58. The components 57, 58 may thus continue to operate.

As outlined above, the blowing of a fuse in the dielectric liquid filled and pressurized fuse assembly 10 will cause a small explosion generating gases, combustion products and debris. The sealed enclosure 11 of the subsea fuse assembly 10 will protect the electric components in the electric device 50 from the explosion and further prevent the gases and combustion products from contaminating the dielectric liquid 52.

In summary, the embodiments outlined above provide a subsea fuse assembly that includes a sealed and pressure compensated enclosure. This enables the use of fuses in a pressurized environment. Consequently, no atmospheric canisters are needed for housing fuses. The subsea fuse assembly is compact and lightweight, and the technical complexity (e.g., of the penetrators) may be reduced. Also, the reliability may be increased (e.g., as the fuses are sealed off from other electric components).

The skilled person will appreciate that the features explained above with respect to the figures and the different embodiments of the invention may be combined in other combinations as the ones illustrated.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A subsea electric device comprising:

a first enclosure, the first enclosure being pressure compensated and being filled with a first dielectric liquid;

an electric component submerged in the first dielectric liquid;

a subsea fuse assembly comprising:

a second enclosure filled with a second dielectric liquid;

a first pressure compensator comprising a flexible element configured to perform a pressure equalization between an inside of the second enclosure and the pressurized environment outside of the second enclosure, the first pressure compensator being mounted to the second enclosure and sealing an opening in the second enclosure;

a first penetrator and a second penetrator each passing through a wall of the second enclosure for leading a first electric conductor and a second electric conductor, respectively, into the second enclosure; and a fuse arranged inside the second enclosure and connected between the first electric conductor and the second electric conductor; and a second pressure compensator configured such that when the subsea electric device is installed at a sea bed, a pressure inside the subsea electric device and a pressure acting on the subsea fuse assembly is substantially similar to a water pressure at a location of the subsea electric device, wherein the subsea fuse assembly is configured such that the inside of the second enclosure is sealed to the outside of the second enclosure, and wherein the subsea fuse assembly is submerged in the first dielectric liquid and is electrically coupled to the electric component.

2. The subsea electric device according to claim 1, wherein the flexible element is a membrane, a bladder, a bellow, or a combination thereof.

3. The subsea electric device according to claim 1, wherein the flexible element is arranged so as to seal the opening in the second enclosure, the flexible element being deformable such that a deformation of the flexible element results in a change of a volume confined by the second enclosure.

4. The subsea electric device according to claim 3, wherein the flexible element comprises a membrane, the membrane being arranged to seal the opening in the enclosure, wherein the membrane is deformable into an equilibrium position in accordance with a force applied to the membrane by a pressure outside the enclosure and a force applied to the membrane by a pressure inside the second enclosure, and wherein in the equilibrium position, the pressure inside the second enclosure is equalized to the pressure outside the second enclosure.

5. The subsea electric device according to claim 1, wherein the flexible element is a membrane selected from the group consisting of a rubber membrane, a nitrile rubber membrane, a thermoplastic polyurethanes (TPU) membrane, a membrane comprising polyester filaments, a membrane comprising polyvinyl chloride, and a butyl rubber membrane.

6. The subsea electric device according to claim 1, wherein the fuse arranged inside the second enclosure and connected between the first electric conductor and the second electric conductor comprises a fuse housing.

7. The subsea electric device according to claim 1, wherein the fuse arranged inside the second enclosure and connected between the first electric conductor and the second electric conductor comprises two terminals and a fuse element coupled to the two terminals, the fuse element comprising a metal wire or a metal sheet.

8. The subsea electric device according to claim 1, wherein the fuse is a first fuse, and wherein the subsea fuse assembly further comprises at least a second fuse and two further penetrators each passing through a wall of the second enclosure, the second fuse being connected between conductors lead into the second enclosure by the two further penetrators.

9. The subsea electric device according to claim 1, wherein the first penetrator and the second penetrator are configured to provide an electric insulation between the second enclosure and the respective electric conductor and to provide a seal between the inside of the second enclosure and the outside of the second enclosure.

10. The subsea electric device according to claim 1, wherein the fuse arranged inside the second enclosure and connected between the first electric conductor and the second electric conductor has a current rating in a range of 500 to 10000 A.

11. The subsea fuse assembly according to claim 10, wherein the current rating is in the range of 1000 to 5000 A.

12. The subsea electric device according to claim 1, wherein sealing between the inside of the second enclosure and the outside of the second enclosure is a fluid-tight sealing.

13. The subsea electric device according to claim 1, wherein the second enclosure is a box shaped enclosure having an open side, the flexible element being a membrane sealing the open side.

14. The subsea electric device according to claim 13, wherein at the open side, the second enclosure is provided with a flange, the membrane being arranged and compressed between the flange and a further mating flange.

15. The subsea electric device according to claim 1, wherein the second enclosure is made from metal and is provided with a layer of insulating material lining inner faces of the second enclosure.

16. The subsea fuse assembly according to claim 15, wherein the insulating material is a polycarbonate material.

17. The subsea electric device according to claim 1, wherein the second enclosure is filled with dielectric liquid, the fuse being submerged in the dielectric liquid.

* * * * *